US010952485B1

(12) United States Patent
Armagost et al.

(10) Patent No.: US 10,952,485 B1
(45) Date of Patent: Mar. 23, 2021

(54) HAT AND PHONE MOUNT SYSTEM AND METHOD OF USE

(71) Applicants: Timothy Paul Armagost, Centennial, CO (US); Shenandoah Levesque, Centennial, CO (US)

(72) Inventors: Timothy Paul Armagost, Centennial, CO (US); Shenandoah Levesque, Centennial, CO (US)

( * ) Notice: Subject to any disclaimer, the term of this patent is extended or adjusted under 35 U.S.C. 154(b) by 0 days.

(21) Appl. No.: 16/446,250

(22) Filed: Jun. 19, 2019

Related U.S. Application Data

(60) Provisional application No. 62/684,689, filed on Jun. 13, 2018.

(51) Int. Cl.
*A42B 1/00* (2006.01)
*A42B 1/245* (2021.01)
*A42B 1/02* (2006.01)

(52) U.S. Cl.
CPC ..... *A42B 1/245* (2013.01); *A42B 1/02* (2013.01)

(58) Field of Classification Search
CPC ..... A42B 1/245; A42B 1/02
USPC ..... 224/181
See application file for complete search history.

(56) References Cited

U.S. PATENT DOCUMENTS 6,028,627 A * 2/2000 Helmsderfer ..... A42B 3/042 345/8
8,316,467 B2 * 11/2012 Foust ..... A42B 1/245 2/195.1
8,342,758 B2 * 1/2013 Braithwaite ..... A42B 1/242 396/419
8,646,739 B2 * 2/2014 Moyer ..... H04M 1/04 248/201
9,609,902 B2 * 4/2017 Waters ..... A42B 1/24
2003/0106918 A1 * 6/2003 Hung ..... A45F 5/02 224/222
2005/0127296 A1 * 6/2005 Reilly ..... A42B 3/042 250/330
2010/0287685 A1 * 11/2010 Peterson ..... A42B 1/245 2/209.13
2011/0097069 A1 * 4/2011 Braithwaite ..... G03B 17/561 396/420
2012/0264492 A1 * 10/2012 Stewart ..... H04B 1/385 455/575.2
2014/0294366 A1 * 10/2014 Fletchall ..... H04N 13/189 386/341
2015/0358515 A1 * 12/2015 Resnick ..... F16M 11/041 348/373
2018/0017796 A1 * 1/2018 Toso ..... G02B 27/0176

* cited by examiner

*Primary Examiner* — Peter N Helvey
(74) *Attorney, Agent, or Firm* — Richard Eldredge; Leavitt Eldredge Law Firm

(57) ABSTRACT

A hat and phone mount system include a hat having a hat body to secure to a head of a wearer; and a phone mount, having a first portion and a second portion connected to a front of the hat body and extending therefrom, the phone mount to receive and hold a phone in front of the hat; the phone mount is to facilitate holding of the phone with the hat as needed by the user.

3 Claims, 5 Drawing Sheets

HAT AND PHONE MOUNT SYSTEM AND METHOD OF USE

BACKGROUND

1. Field of the Invention

The present invention relates generally to cell phones and cell phone holding systems, and more specifically, to a hat and phone mount system for using a phone with a hat handsfree.

2. Description of Related Art

Using cell phones is well known in the art. One popular means for using a cell phone is for video chatting or conferencing. For example, FIG. 1 depicts a conventional cell phone system 101 having a phone 103 being held by a user 105. During use, the user is limited to the use of their other hand for activities while using the phone for video chatting or the like.

One of the problems commonly associated with system 101 is this limited availability of a user's hands. For example, the user may be video conferencing for the purpose of receiving direction from the other party for the completion of a task. In such an example, the user may have to hold the phone to show the other party the task they are working on, which limits the user to one hand to perform the task. This limitation can be difficult and annoying for both parties.

Accordingly, although great strides have been made in the area of cell phone systems, many shortcomings remain.

DESCRIPTION OF THE DRAWINGS

The novel features believed characteristic of the embodiments of the present application are set forth in the appended claims. However, the embodiments themselves, as well as a preferred mode of use, and further objectives and advantages thereof, will best be understood by reference to the following detailed description when read in conjunction with the accompanying drawings, wherein:

Figure 1:
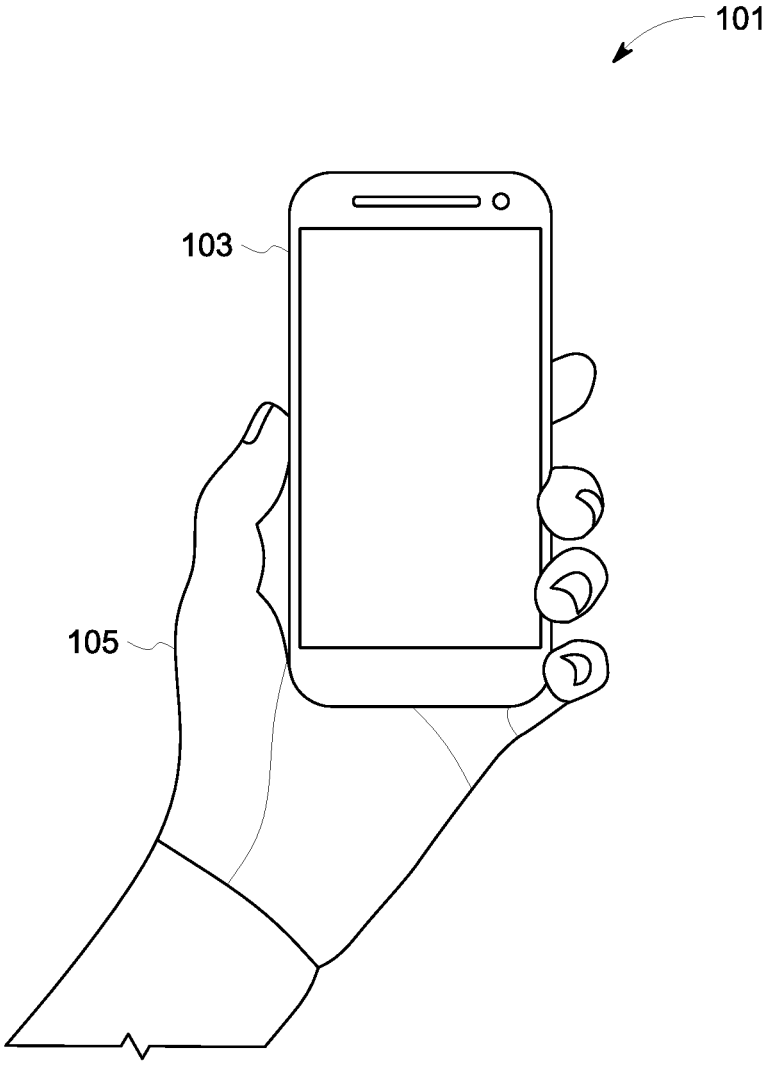
FIG. 1 (PRIOR ART)
FIG. 1 is a front view of a common cell phone system.
Figure 2:
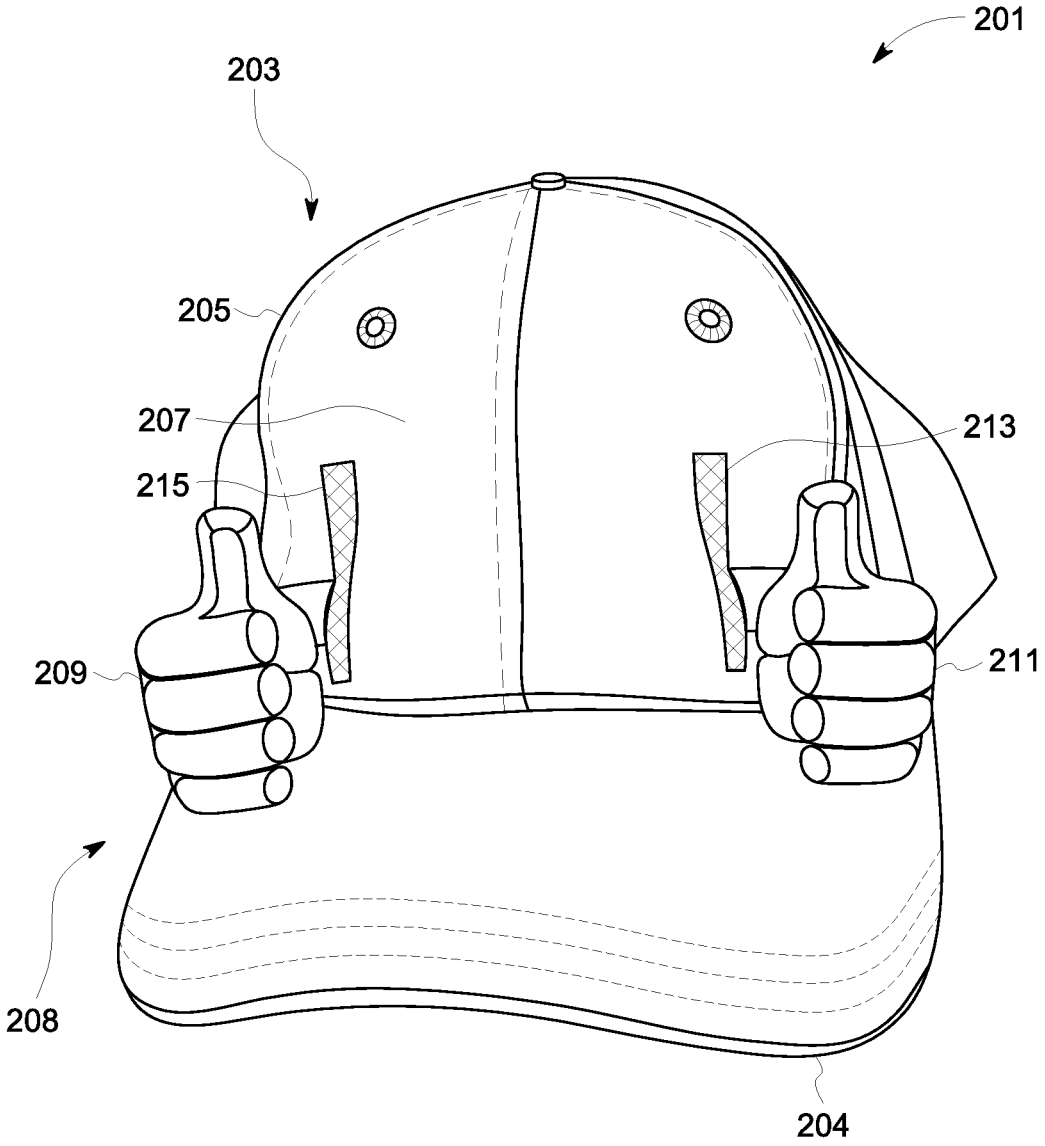
FIG. 2 is a front view of a hat and phone mount system in accordance with a preferred embodiment of the present application.

While the system and method of use of the present application is susceptible to various modifications and alternative forms, specific embodiments thereof have been shown by way of example in the drawings and are herein described in detail. It should be understood, however, that the description herein of specific embodiments is not intended to limit the invention to the particular embodiment disclosed, but on the contrary, the intention is to cover all modifications, equivalents, and alternatives falling within the spirit and scope of the present application as defined by the appended claims.

DETAILED DESCRIPTION OF THE PREFERRED EMBODIMENT

Illustrative embodiments of the system and method of use of the present application are provided below. It will of course be appreciated that in the development of any actual embodiment, numerous implementation-specific decisions will be made to achieve the developer's specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The system and method of use in accordance with the present application overcomes one or more of the above-discussed problems commonly associated with conventional cell phone systems. Specifically, the present invention provides for the user to use a cell phone hands free. These and other unique features of the system and method of use are discussed below and illustrated in the accompanying drawings.

The system and method of use will be understood, both as to its structure and operation, from the accompanying drawings, taken in conjunction with the accompanying description. Several embodiments of the system are presented herein. It should be understood that various components, parts, and features of the different embodiments may be combined together and/or interchanged with one another, all of which are within the scope of the present application, even though not all variations and particular embodiments are shown in the drawings. It should also be understood that the mixing and matching of features, elements, and/or functions between various embodiments is expressly contemplated herein so that one of ordinary skill in the art would appreciate from this disclosure that the features, elements, and/or functions of one embodiment may be incorporated into another embodiment as appropriate, unless described otherwise.

The preferred embodiment herein described is not intended to be exhaustive or to limit the invention to the precise form disclosed. It is chosen and described to explain the principles of the invention and its application and practical use to enable others skilled in the art to follow its teachings.

Referring now to the drawings wherein like reference characters identify corresponding or similar elements throughout the several views, FIGS. 2-5 depict various views of a hat and phone mount system 201 in accordance with a preferred embodiment of the present application. It will be appreciated that system 201 provides for a hands free solution for the use of the cell phone.

Figure 4:
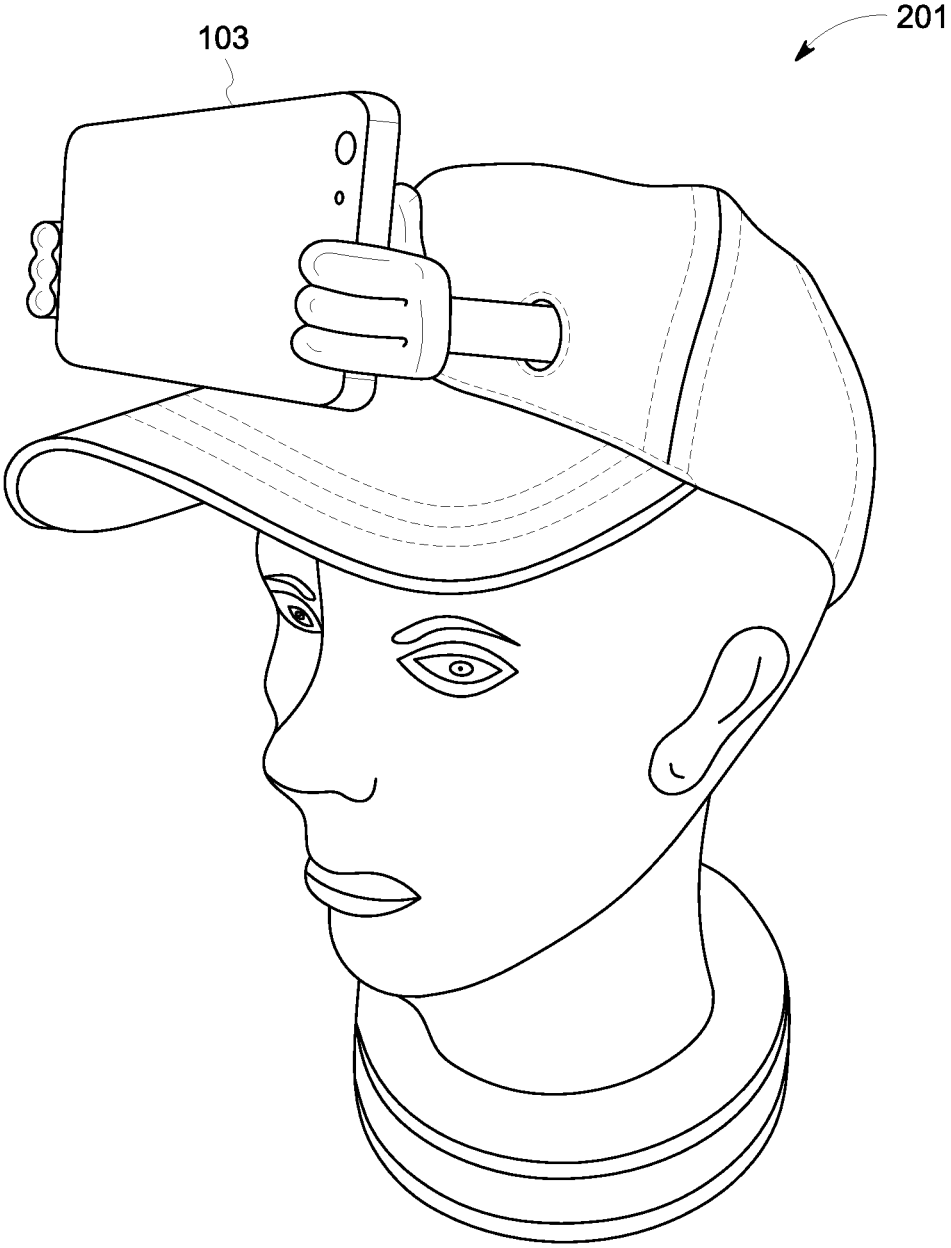
FIG. 4 is an isometric view of the system of FIG. 2 with a phone secured therein.

In the contemplated embodiment, system 201 includes a hat 203 having a hat body 205 configured to fit around the head of the wearer. It should be appreciated that the hat 203 can vary in design and shape, and can optionally include a brim 204 or other aesthetically pleasing features. System 201 further includes a phone mount 208 having a first portion 209 and a second portion 211 attached to and extending from a front 207 of the hat body, wherein the phone mount 208 is configured to hold a phone 103 in front of the hat, as shown in FIG. 4.

Figure 3:
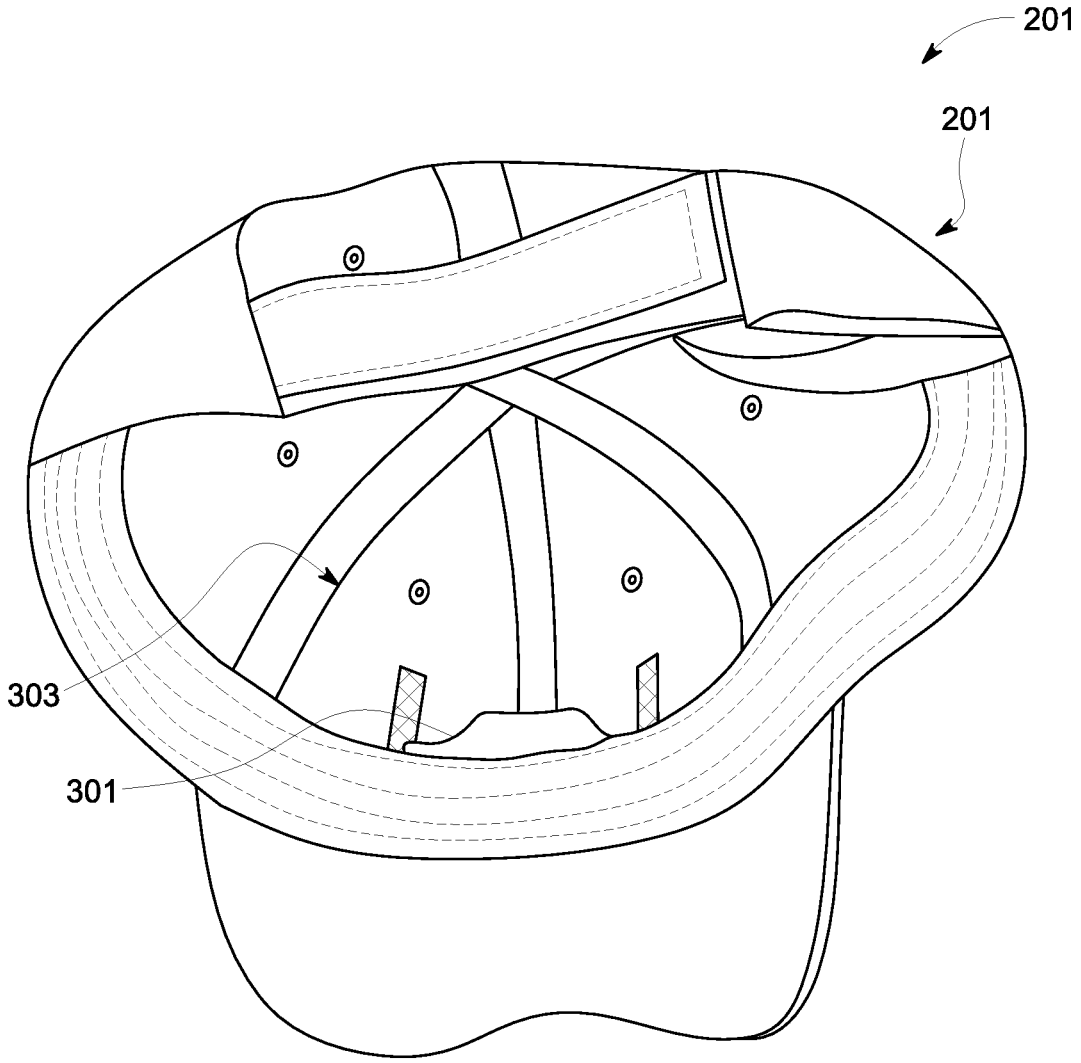
FIG. 3 is an inside view of the hat and phone mount system of FIG. 2.
Figure 5:
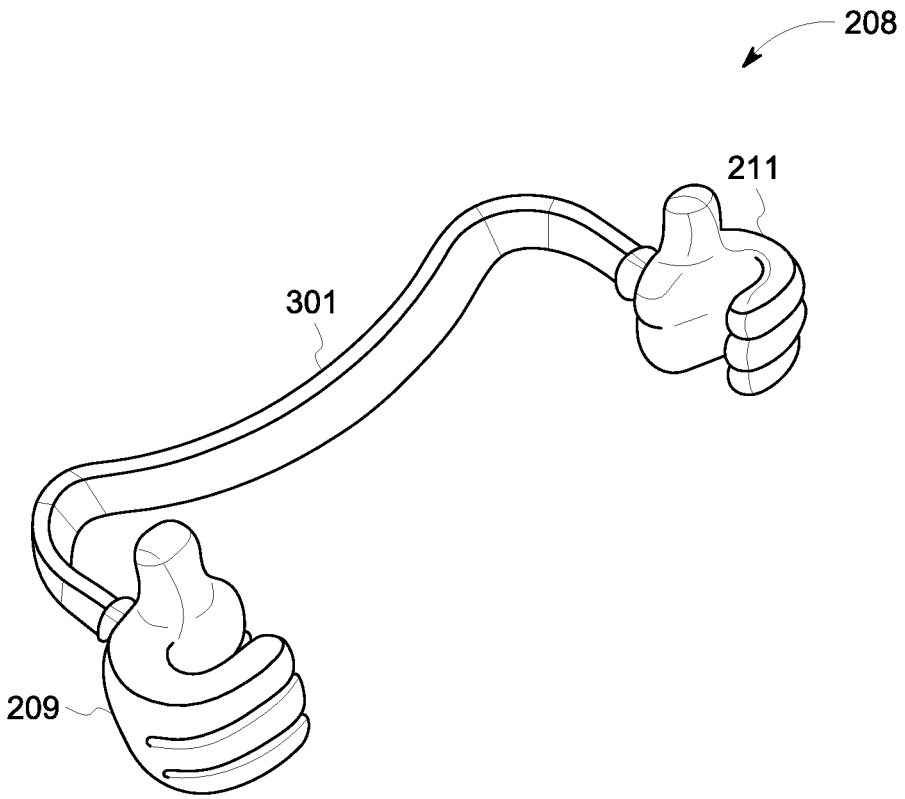
FIG. 5 is an isometric view of a phone mount of FIG. 2.

It should be appreciated that there can be various means of attaching the phone mount 208 to the hat, however, in the preferred embodiment, a first slit 213 and a second slit 215 are cut through a thickness of the front of the hat, wherein the phone mount thereby extends through the slit. As shown in FIGS. 3 and 5, in the preferred embodiment, the phone mount 208 includes a back portion 301 that is positioned on the inside 303 of the hat, such that the back portion 301 holds the mount in place.

It should be appreciated that one of the unique features believed characteristic of the present application is the phone mount, wherein the mount provides for the holding of a phone in front of the user. This feature allows for the user to active the phone, while wearing the hat and mount system, and merely point their head in the direction that they desire the phone to face. This allows for the user to use the phone in a hand's free scenario.

It should be appreciated that the phone mount can vary, however, as shown in FIG. 5, in the preferred embodiment, the first side 209 is a first hand, and the second side 211 is a second hand, wherein the hands are configured to engage with opposite sides of the phone to secure the phone in place. It should further be appreciated that the materials of the mount can vary, and can be any material that is capable of flexing to engage with the phone, such as plastics, rubbers, silicones, or the like.

Figure 6:
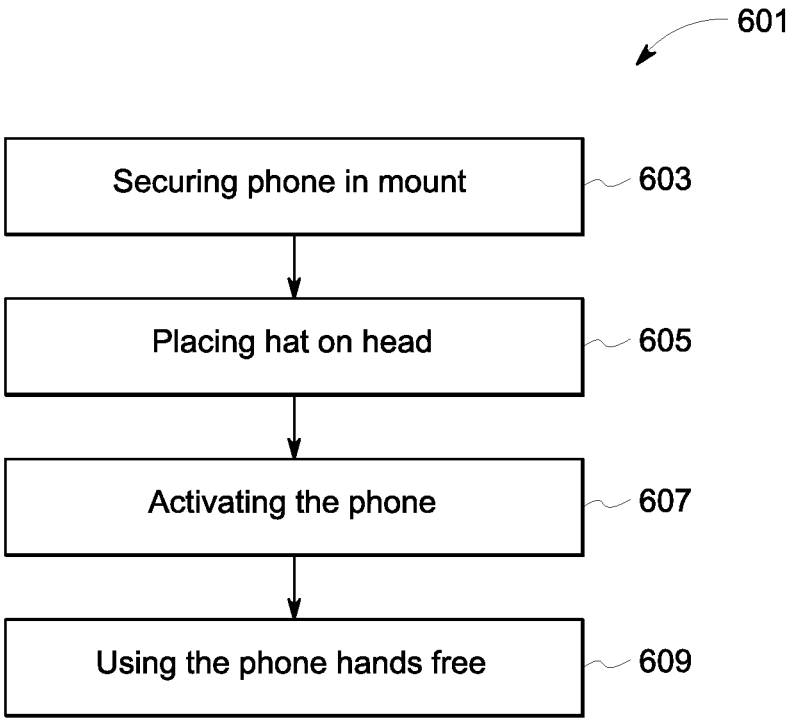
FIG. 6 is a flowchart of the method of use of the system of FIG. 2.

In FIG. 6, a flowchart 601 depicts a method of use of the system 201. During use, the user will secure the phone in the mount and place the hat on their head, as shown with boxes 603, 605. The user can then activate the phone and use the phone handsfree, as they desire, as shown with boxes 607, 609. The user can proceed to video chat easily by facing the lens of the phone outward and away from the user. It should be appreciated and understood that the system is not limited to video chatting, and can be used for games, listening to music, or any other appropriate use. Further, the system can be used as a head directional flashlight by turning the back of the phone outward appropriately.

The particular embodiments disclosed above are illustrative only, as the embodiments may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. Although the present embodiments are shown above, they are not limited to just these embodiments, but are amenable to various changes and modifications without departing from the spirit thereof.

What is claimed is:

1. A hat and phone mount system, comprising:

a hat having a hat body configured to secure to a head of a wearer; and a phone mount, having a first portion and a second portion connected to a front of the hat body and extending therefrom, the phone mount configured to receive and hold a phone in front of the hat;

wherein the phone mount is configured to facilitate holding of the phone with the hat as needed by the user; and wherein the first portion is a first flexible hand configured to grasp a first side of the phone and the second portion is a second flexible hand configured to grasp a second side of the phone.

2. The system of claim 1, wherein the phone mount further comprises:

a back portion connected to the first portion and the second portion on an inside of the hat body.

3. The system of claim 2, wherein the first portion and the second portion extend through a thickness of the body of the hat.

* * * * *